US005839784A

United States Patent [19]

Breen

[11] Patent Number: 5,839,784

[45] Date of Patent: Nov. 24, 1998

[54] CHAIR CONTROL

[75] Inventor: William R. Breen, Etobicoke, Canada

[73] Assignee: Nightingale Inc., Mississauga, Canada

[21] Appl. No.: 864,821

[22] Filed: May 29, 1997

[30] Foreign Application Priority Data

Mar. 27, 1997 [CA] Canada ..... 2201253

[51] Int. Cl.[6] ..... B60N 2/22; B60N 2/46

[52] U.S. Cl. ..... 297/383; 297/301.1; 297/301.7; 297/411.35; 297/411.37

[58] Field of Search ..... 297/383, 411.35, 297/411.37, 301.1, 301.7; 248/118

[56] References Cited

U.S. PATENT DOCUMENTS

| | | | |
|---|---|---|---|
| 413,156 | 10/1889 | Wilkerson . | |
| 455,168 | 6/1891 | Case . | |
| 1,955,969 | 4/1934 | Marzolf . | |
| 2,142,454 | 1/1939 | Needham . | |
| 3,224,807 | 12/1965 | Welch et al. | 297/383 X |
| 3,586,374 | 6/1971 | Laessker . | |
| 4,085,967 | 4/1978 | Spencer . | |
| 4,099,774 | 7/1978 | Sandham | 297/301.1 X |
| 4,102,549 | 7/1978 | Morrison et al. | 297/383 |
| 4,536,031 | 8/1985 | Latone | 297/383 X |
| 4,884,846 | 12/1989 | Tobler . | |
| 5,338,133 | 8/1994 | Tornero | 297/411.37 X |
| 5,462,338 | 10/1995 | Baumann | 297/383 X |
| 5,511,852 | 4/1996 | Kusiak et al. | 297/383 X |
| 5,660,442 | 8/1997 | Tornero | 297/411.37 X |

FOREIGN PATENT DOCUMENTS

| | | | |
|---|---|---|---|
| 11707 | 10/1990 | WIPO | 297/383 |

*Primary Examiner*—Laurie K. Cranmer
*Assistant Examiner*—Rodney B. White
*Attorney, Agent, or Firm*—Barrigar & Moss

[57] ABSTRACT

A chair control is shown for adjusting the horizontal position of a chair armrest or a chair back. A support bar, upon which the chair armrest or back is mounted, a slidably located in a mounting bracket usually attached to the underside of the chair seat. The mounting bracket includes a first pivot pin spaced transversely of the support bar, and a rigid lever mounted on this pivot pin, the pivot pin acting as a fulcrum. The rigid lever includes a first end portion that pivots into locking engagement with the support bar and a second remote end portion. An over-the-center toggle linkage is coupled to the lever second end portion to rotate the lever about the pivot pin to engage the support bar and lock it in position.

20 Claims, 10 Drawing Sheets

CHAIR CONTROL

BACKGROUND OF THE INVENTION

This invention relates to adjustment mechanisms for furniture, and in particular, to devices for adjusting the position of the armrests or backs of chairs.

In items of furniture, such as chairs and especially office chairs, it is desirable to be able to adjust the position of the chair backs, or the chair armrests where provided. Usually these chair backs or armrests are mounted on a metal support arm, and the support arm is mounted in or forms part of an adjustment mechanism mounted somewhere on the chair. The support arm slides or telescopes to provide the position adjustment of the chair armrest or back, and some type of locking device is required to hold the support arm in the desired position.

Chair armrests and backs are subjected to considerable lateral forces, so it is necessary to have a very strong or positive locking mechanism to hold them in place. One common way of doing this in the past is to provide a locking pin or bar to engage spaced-apart holes or slots in the support arm. To adjust the position of the chair armrests or back, the locking pin or bar is disengaged from a particular hole or slot in the support arm, the support arm is moved to its new position, and the locking pin or lever is engaged in another hole or slot to again lock the support arm in position. A difficulty with this type of locking mechanism, however, is that there only a descrete or finite number of fixed positions in which the chair armrest or back can be adjusted depending upon the spacing of the holes or slots in the support arms. It would be better to provide infinite adjustment between reasonable limits, but this cannot be done with this type of mechanism.

It is possible to get infinite adjustment, however. One way of doing this is to provide a friction clutch or brake type clamp to the support arm on which the chair back or chair armrest is mounted. Usually, thumb screw or cam type devices are used to clamp the support arm in place. The problem with these types of devices, however, is that they do not hold. They either work loose, or dirt or other foreign matter or even stray lubricants from other components in the chair base, interfere with the frictional or clamping action of these devices.

Another approach, which is sort of a combination of the above two approaches, is shown in U.S. Pat. No. 5,462,338 issued to Stephen J. Baumann. This patent shows the use of a nylon, notched locking track, with a pin that moves into and out of the notches. A toggle clamp type device moves the pin into and out of the notches and lock it in a desired notch. A problem with this type of device, however, is that it is difficult to engage and disengage, and it only gives limited adjustment due to the size of the notches.

The present invention is an improvement over the above types of devices in that the locking mechanism is easy to engage and disengage, yet gives as much clamping force as is required. The present invention uses the combination of a lever to engage the support arm and a toggle linkage to operate the lever.

BRIEF SUMMARY OF THE INVENTION

According to one aspect of the invention, there is provided a chair control for adjusting the position of a chair armrest or back having a transverse support bar on which the armrest or back is mounted. The chair control comprises a mounting bracket having a slot for slidably retaining the support bar therein to permit longitudinal position adjustment thereof. The mounting bracket includes a first pivot pin spaced transversely of the support bar. A rigid lever is pivotally mounted on the pivot pin. The lever has a first end portion adapted to pivot into friction of engagement with the support bar and a second end portion remote therefrom. The mounting bracket has a second pivot pin spaced from the first pivot pin. A toggle linkage having a central pivot and opposed links is coupled respectively between the lever second end portion and the second pivot pin, so that transverse reciprocal movement of the central pivot causes the lever first end portion to pivot into and out of engagement with the support bar. Also, means are provided for releasably retaining the toggle linkage in a locked position where the lever first end portion is in engagement with the support bar.

According to another aspect of the invention, there is provided a chair control for adjusting the position of a chair component such as an armrest or a back. The chair control comprises a support bar for mounting the chair component thereon. A mounting bracket is provided having a slot for slidably retaining the support bar therein to permit longitudinal position adjustment thereof. The mounting bracket includes a first pivot pin spaced transversely of the support bar. A rigid lever is pivotally mounted on the pivot pin. The lever has a first end portion adapted to pivot into frictional engagement with the support bar and a second end portion remote therefrom. The mounting bracket has a second pivot pin spaced from the first pivot pin. A toggle linkage has a central pivot and opposed links coupled respectively between the lever second end portion and the second pivot pin, so that transverse reciprocal movement of the central pivot causes the lever first end portion to pivot into and out of engagement with the support bar. Also, means are provided for releasably retaining the toggle linkage in a locked position where the lever first end portion is in engagement with the support bar.

BRIEF DESCRIPTION OF THE PREFERRED EMBODIMENTS

Preferred embodiments of the invention will now be described, by way of example, with reference to the accompanying drawings, in which:

FIG. 1 is a front elevational view of a portion of a chair employing a preferred embodiment of a chair control according to the present invention to adjust the position of a chair armrest;

FIG. 1*a* is a side elevational view of a portion of a chair having another preferred embodiment of a chair control according to the present invention employed to adjust the position of a chair back;

DETAILED DESCRIPTION OF THE PREFERRED EMBODIMENT

Figure 1A:
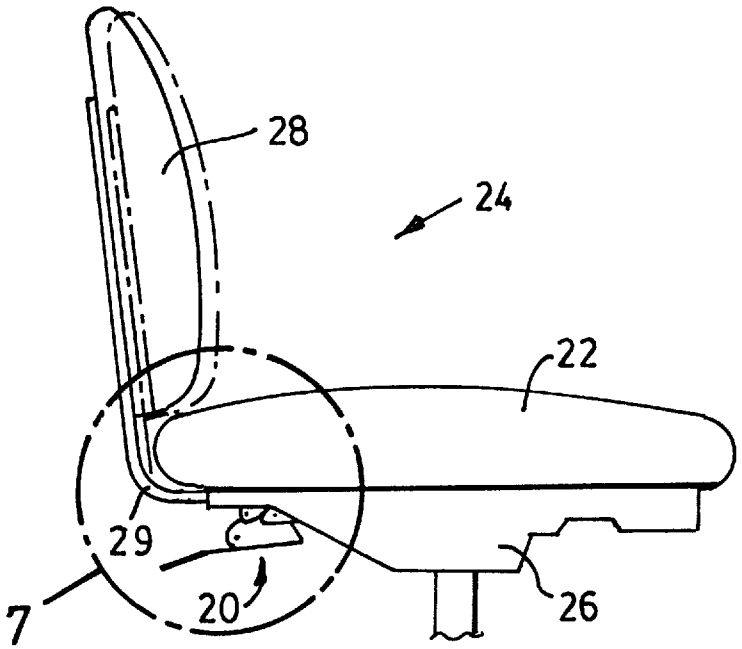
Figure 1:
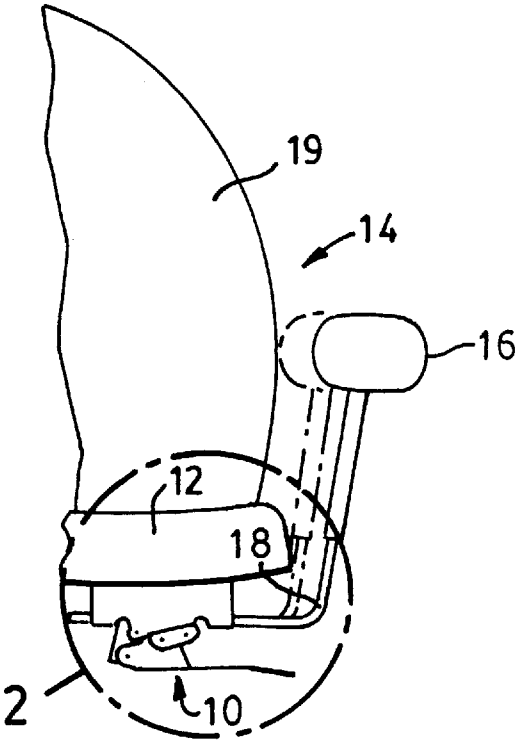

Referring firstly to FIG. 1, a preferred embodiment of a chair control according to the present invention is generally indicated by reference numeral 10. Chair control 10 is mounted on the underside of a chair seat 12 of a chair 14. Chair 14 has armrests 16, only one of which is shown in FIG. 1. Armrest 16 is mounted on a support arm 18. Chair 14 also has a chair back 19.

Referring next to FIG. 1*a*, another preferred embodiment of a chair control according to the present invention is generally indicated by reference numeral 20. Chair control 20 is also mounted on the underside of a chair seat 22 of a chair 24. In particular, chair control 20 is mounted on a larger chair tilt and height control 26. However, if chair 24 does not have a tilt and height control 26, then chair control 20 can simply be mounted on the underside of chair seat 22. Chair 24 also has a chair back 28. Chair back 28 is mounted on a support arm 29.

Figure 2:
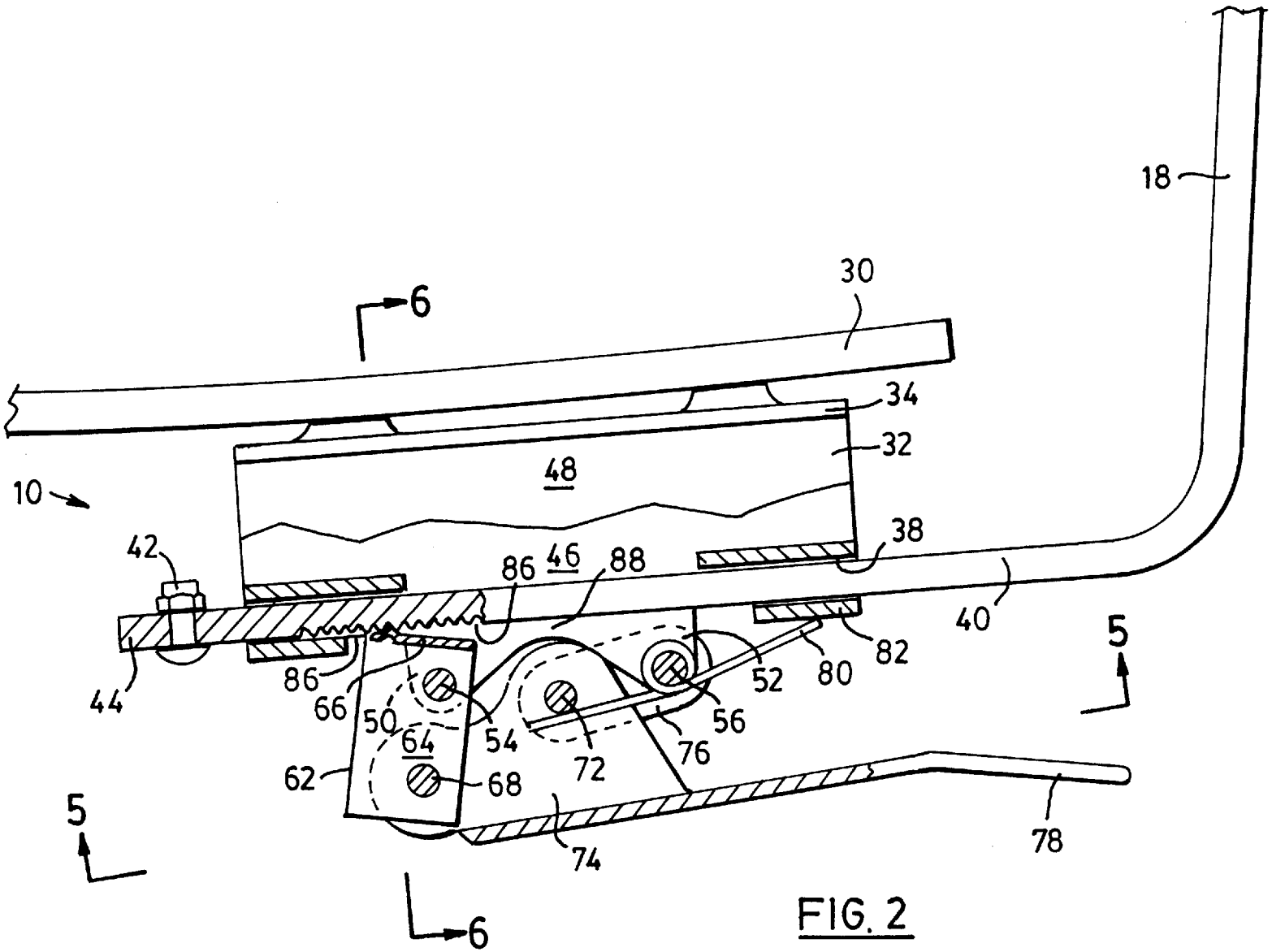
FIG. 2 is an enlarged elevational view, partly broken away, of the portion of FIG. 1 indicated by a chain dotted line 2.
Figure 5:
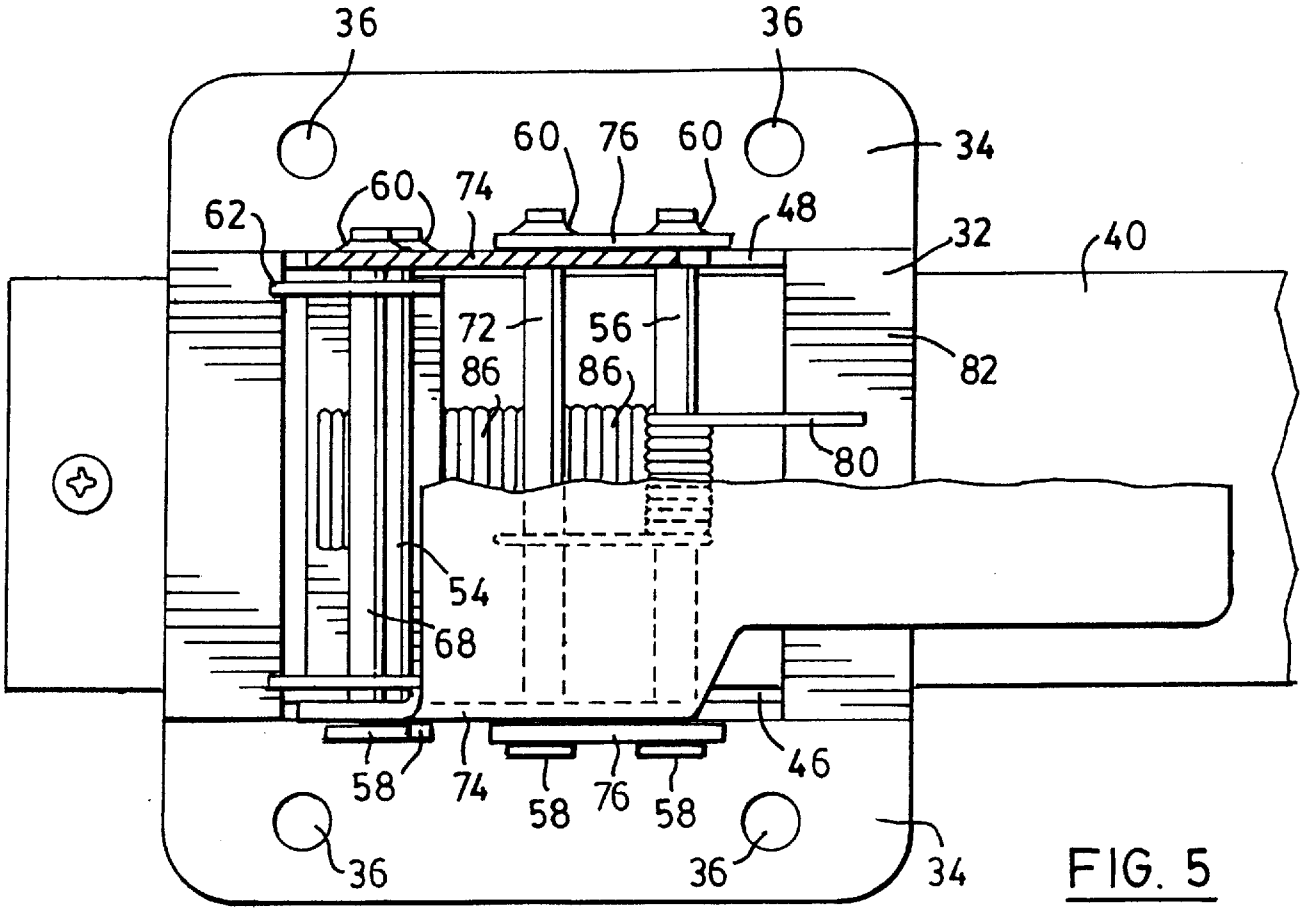
FIG. 5 is a bottom view taken along lines 5—5 of FIG. 2.

Referring next to FIG. 2, chair control 10 is shown mounted on the underside of a frame member 30 which is a typical component of chair seat 12. Chair control 10 includes a mounting bracket 32. Mounting bracket 32 has transverse flanges 34 (see FIGS. 5 and 6) containing holes 36 for accommodating suitable fasteners (not shown) for attaching mounting bracket 32 to frame member 30. It will be appreciated, however, that mounting bracket 32 can be attached to frame member 30 in any other suitable way, with or without transverse flanges 34.

Mounting bracket 32 has a longitudinal slot 38 for slidably retaining a support bar 40 in mounting bracket 32. Support bar 40 is part of support arm 18. It will be appreciated that longitudinal sliding movement of support bar 40 causes armrests 16 to move in and out adjusting the width or spacing between armrests 16. A nut and bolt 42 are mounted on the inside end portion 44 of support bar 40 to form a removable stop to engage mounting bracket 32 and prevent support bar 40 from sliding all the way out of mounting bracket 32.

Figure 6:
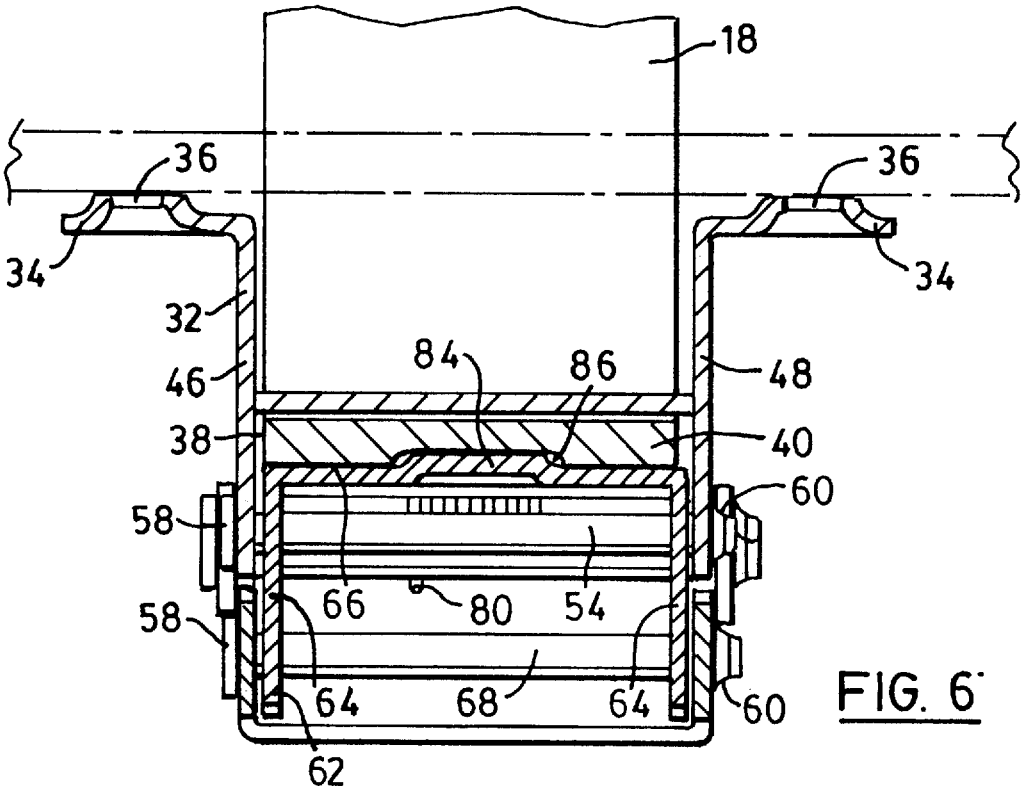
FIG. 6 is a vertical sectional view taken along lines 6—6 of FIG. 2.
Figure 11:
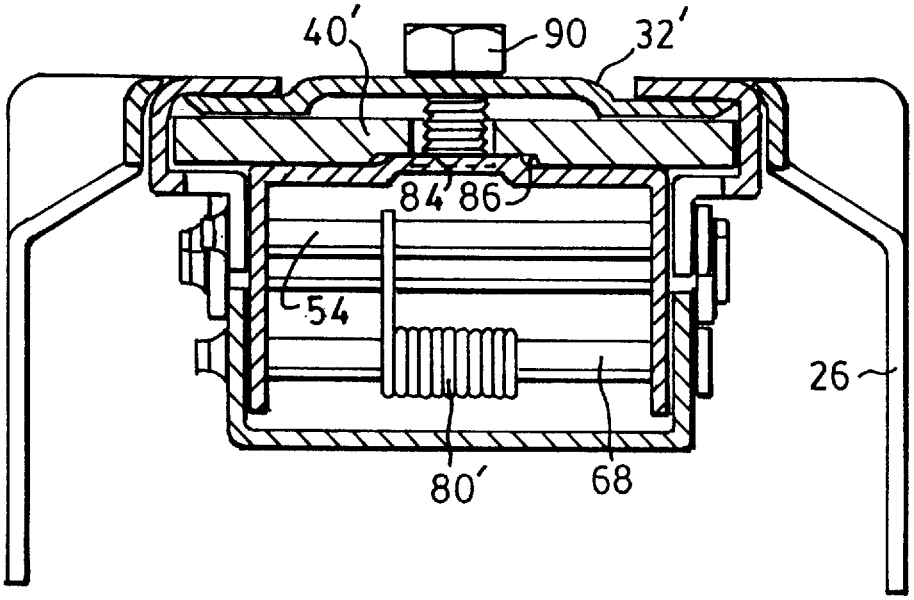
FIG. 11 is a vertical sectional view taken along lines 11—11 of FIG. 7.

As seen best in FIG. 6, mounting bracket 32 has a pair of spaced-apart sidewalls 46, 48 located on either side of support bar 40. Sidewalls 46, 48 have first and second lower extensions 50, 52 (see FIG. 2). A first pivot pin 54 extends between the first lower extensions 50, and a second pivot pin 56 extends between the second lower extensions 52. It will be noted that first pivot pin 54 is spaced transversely of support bar 40, as is second pivot pin 56, although second pivot pin 56 could be located elsewhere in mounting bracket 32, for example, above support bar 40, as will be described further below. Second pivot pin 56 is spaced from first pivot pin 54. Pivot pins 54, 56 can be any type of pin. Preferably, they are cylindrical rods with a head formed on one end. They can be threaded on the opposite end to accept a nut to hold them in place, or pal nuts can be used, if desired. In a preferred embodiment, pins with flat heads 58 (see FIG. 5) and pal nuts 60 are used to hold the pins in place.

A rigid lever 62 is pivotally or hingeably mounted on first pivot pin 54. As seen best in FIG. 6, lever 62 is in the form of an inverted U-shaped bracket. The legs 64 of the "U" are pivotally mounted on first pivot pin 54. The bottom 66 of the "U" forms a first end portion of lever 62 and pivots into frictional engagement with the underside of support bar 40, as will be described further below. The distal end portions of legs 64 form second end portions of lever 62 and have another pivot pin 68 extending therebetween.

It will be noted that lever 62 is mounted with first pivot pin 54 closer to the first end portion or bottom 66 then it is to the second end portions or the distal end portions of legs 62. First pivot pin 54 acts as a fulcrum for lever 62 providing leverage to increase the force of engagement of first end portion 66 with support bar 40.

Figure 3:
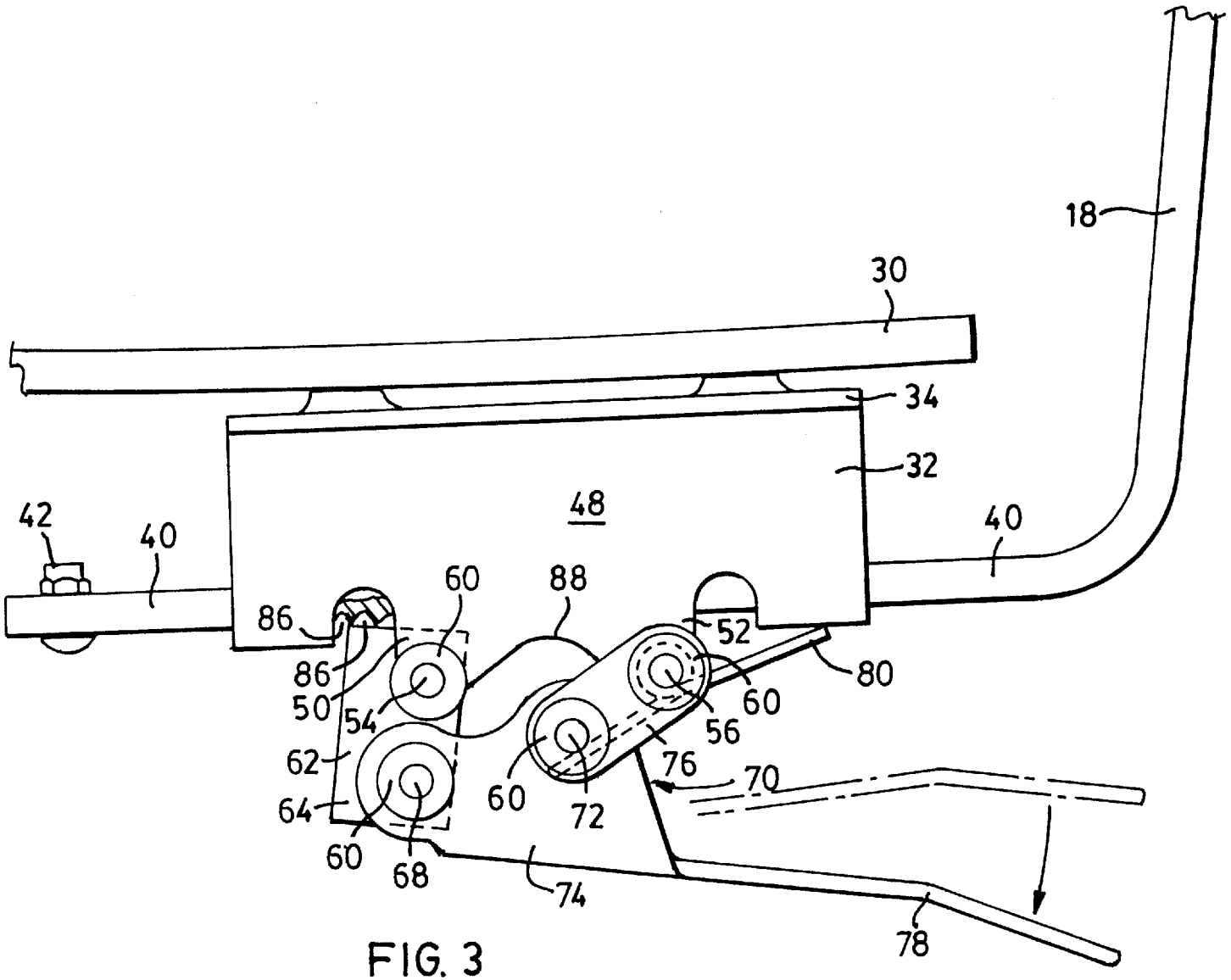
FIG. 3 is an elevational view of the chair control of FIG. 2 showing the control handle in an intermediate position.
Figure 4:
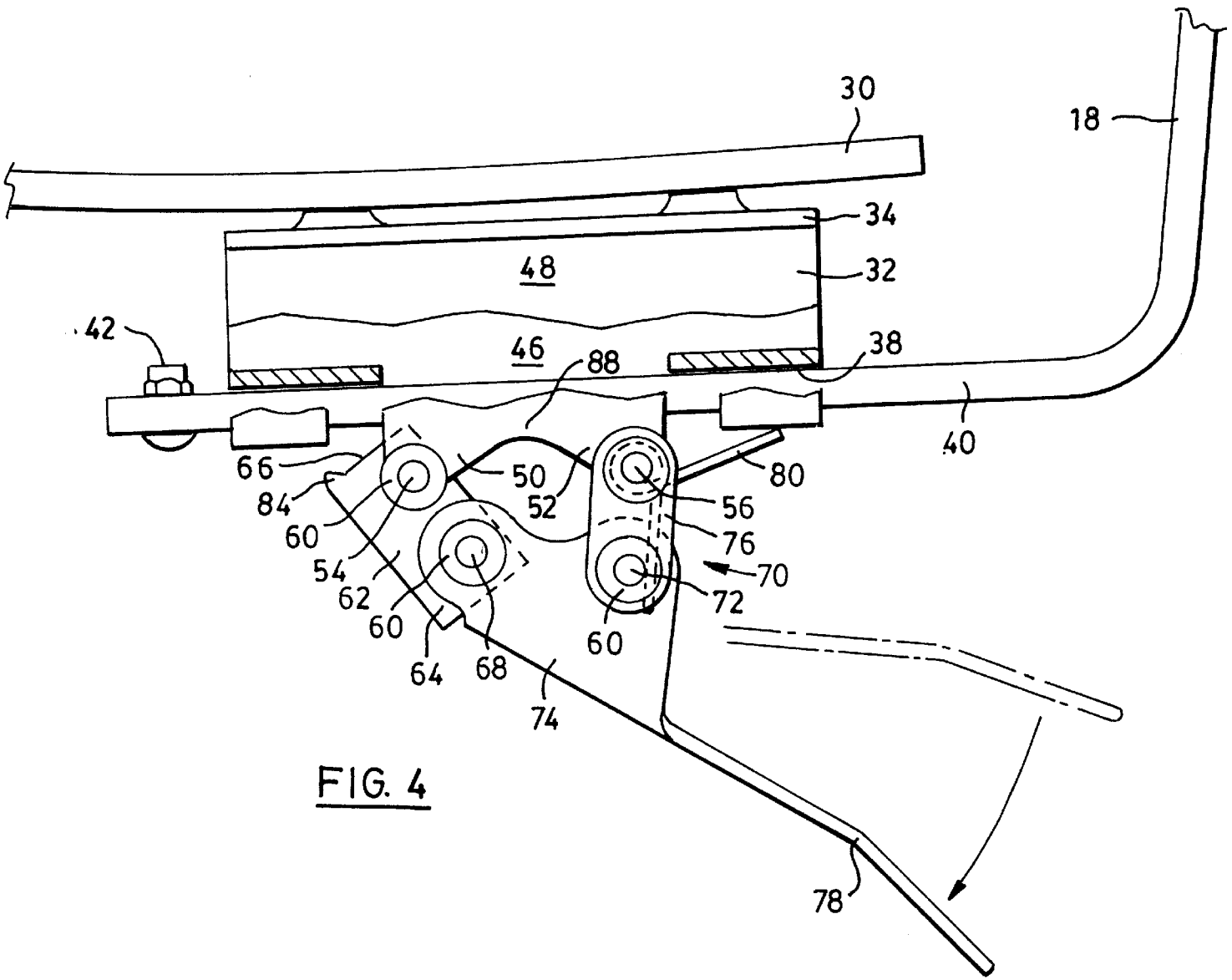
FIG. 4 is an elevational view similar to FIG. 2 but showing the control handle in the disengaged position.

As seen best in FIGS. 3 and 4, a toggle linkage 70 having a central pivot or pivot pin 72 and a opposed links 74 and 76 is coupled respectively between the lever second end portion or legs 64 and second pivot pin 56. Actually, link 74 is pivotally coupled to pivot pin 68 and link 76 is pivotally coupled to first pivot pin 54. Link 74 also has an extension or handle 78 for operating chair control 10, as will be described further below.

A spring 80 is mounted on first pivot pin 56. One end of spring 80 bears against a cross member 82 of mounting bracket 32, and the other end of spring 80 bears against pivot pin 72 to urge pivot pin 72 in an upward direction as seen in FIGS. 2 and 3 and to the left as seen in FIG. 4.

As seen best in FIGS. 4 and 6, the bottom or first end portion 66 of lever 62 is formed with a transverse rigid tooth or edge 84, which selectively engages one of a plurality of transverse parallel grooves 86 located on the underside of support bar 40. Edge or tooth 84 and grooves 86 are optional, or some other means could be used to increase the frictional contact therebetween. For example, grooves 86 could be replaced with a knurled surface and tooth 84 could be a flattened or knurled pad or boss.

In operation, chair control 10 is shown in the fully engaged position in FIG. 2 and support bar 18 is fixed in position because support bar 40 is locked in place in mounting bracket 32. Toggle linkage 70 is an over-the-center toggle, the valley 88 between first and second lower extensions 50, 52 of sidewalls 46, 48 forms a stop in mounting bracket 32 which engages link 74 of toggle linkage 70. Valley or stop 88 is the means for releasably retaining toggle linkage 70 in a locked position.

As handle 78 is moved downwardly as indicated in FIG. 3, toggle linkage 70 is unlocked or moved to the other side of centre. However, spring 80 still urges pivot pin 72 upwardly and lever 62 is still in engagement with support bar 40, so support bar 40 cannot move longitudinally. This is a safety feature, so the armrests cannot fly out sideways unexpectedly if outward pressure or force is being applied to the armrests. When handle 78 is moved further downwardly as indicated in FIG. 4, toggle linkage 70 causes lever 62 to pivot so that tooth 84 is out of engagement with support bar 40 and support bar 40 can be adjusted longitudinally as desired. When the desired position is achieved, handle 78 is released, spring 80 urges the toggle linkage central pivot 72 to move transversely upwardly, which in turn causes lever 62 to pivot once again into engagement with support bar 40 as indicated in FIG. 3. Further upward movement on handle 78 causes toggle linkage 70 or pivot pin 72 to move to the over-the-centre locked position as indicated in FIG. 2, to fully lock the armrest in position once again.

Referring again to FIG. 3, lever 62 is in locking engagement with support bar 40, so toggle linkage 70 is in a locking or locked position even though it is not in a fully locked over-the-centre position as in FIG. 1. Spring 80, therefore, is strong enough to be the means for releasably retaining toggle linkage 70 in the locked position as illustrated in FIG. 3.

It should be noted that handle 78 extends between and connects the adjacent toggle links 74, so that toggle links 74 move in unison and toggle links 76 also move in unison as pivot pin 72 moves transversely in its reciprocal movement to lock and unlock chair control 10.

Figure 7:
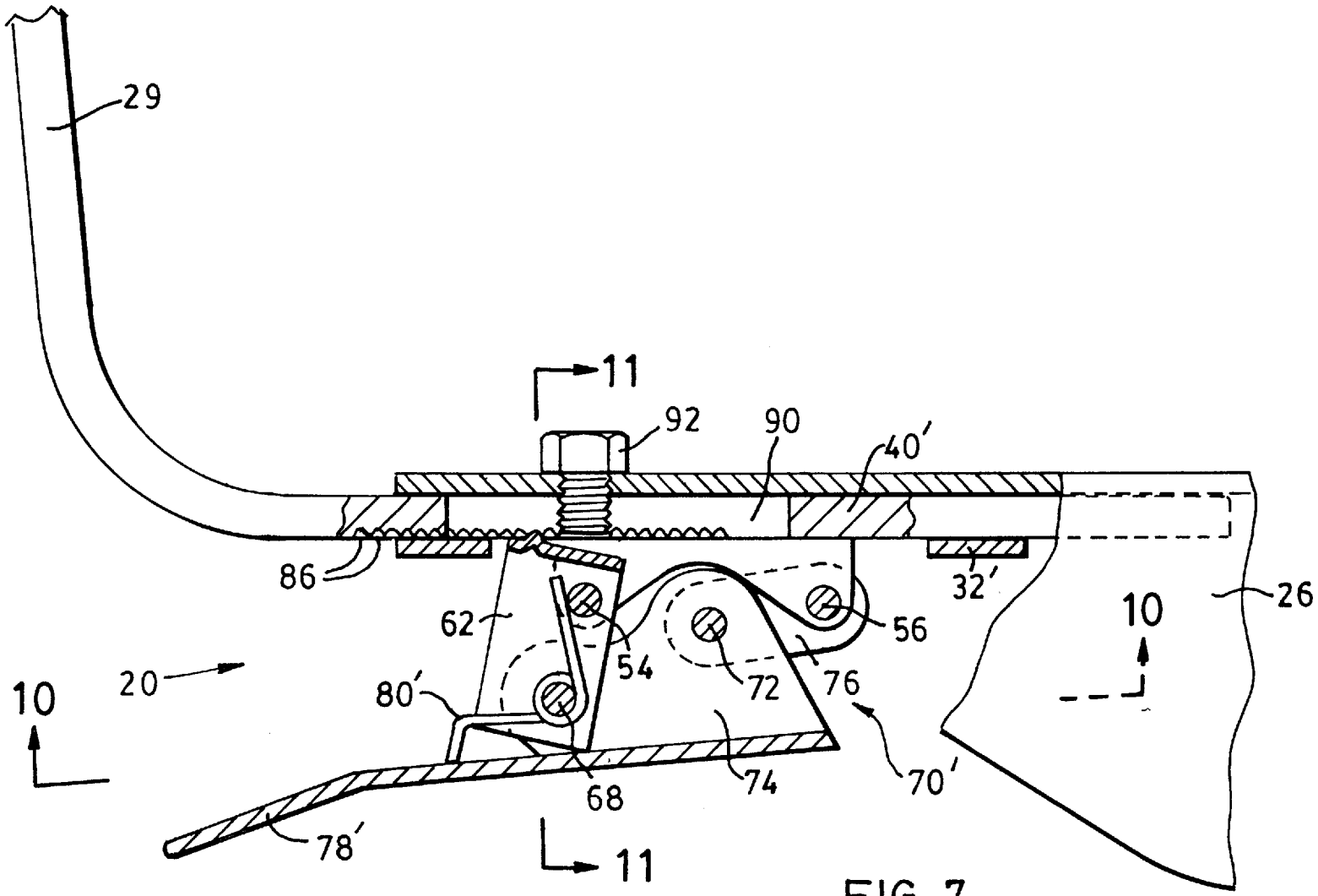
FIG. 7 is an enlarged elevational view, partly broken away of the portion of FIG. 1*a* indicated by chain-dotted line 7.

Referring next to FIGS. 1*a* and 7 to 11, chair control 20 is very similar to chair control 10. Primed reference numerals have been used to indicate components that have been modified or differ from the comparable components in the embodiment of FIGS. 1 to 6. Referring first to FIG. 7, it will be noted that handle 78' extends in a direction opposite to handle 78, yet it is still attached to or part of links 74. Spring 80' is now mounted on pivot pin 68 and urges handle 78' downwardly, which in turn urges pivot pin 72 upwardly into the locked position. Support bar 40' is formed with a central longitudinal slot 90, and a bolt 92 extends into slot 90 to act as a removable stop to prevent support bar 40' from sliding all the way out of mounting bracket 32'.

Figure 8:
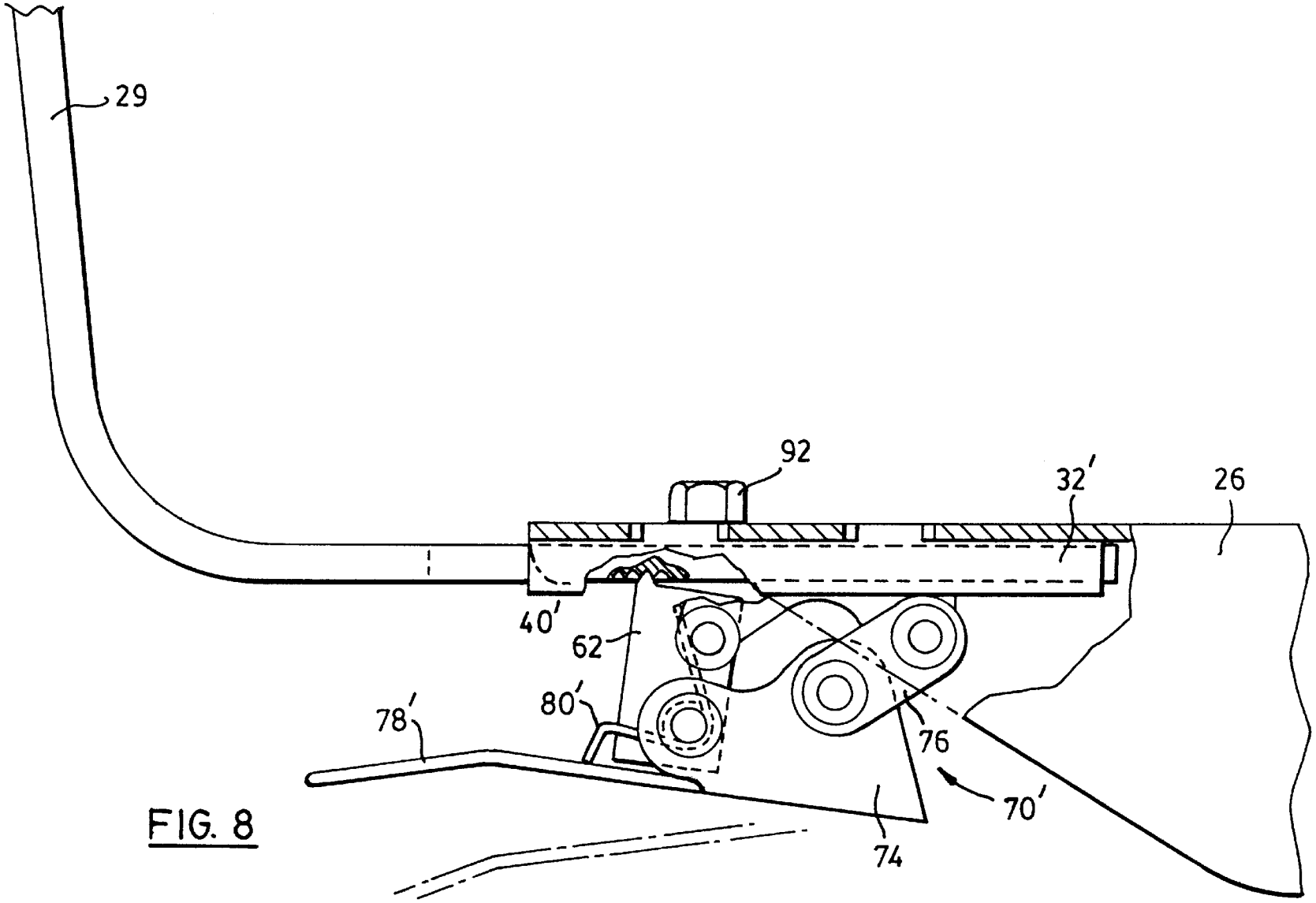
FIG. 8 is an elevational view of the chair control of FIG. 7 showing the handle in an intermediate position.
Figure 9:
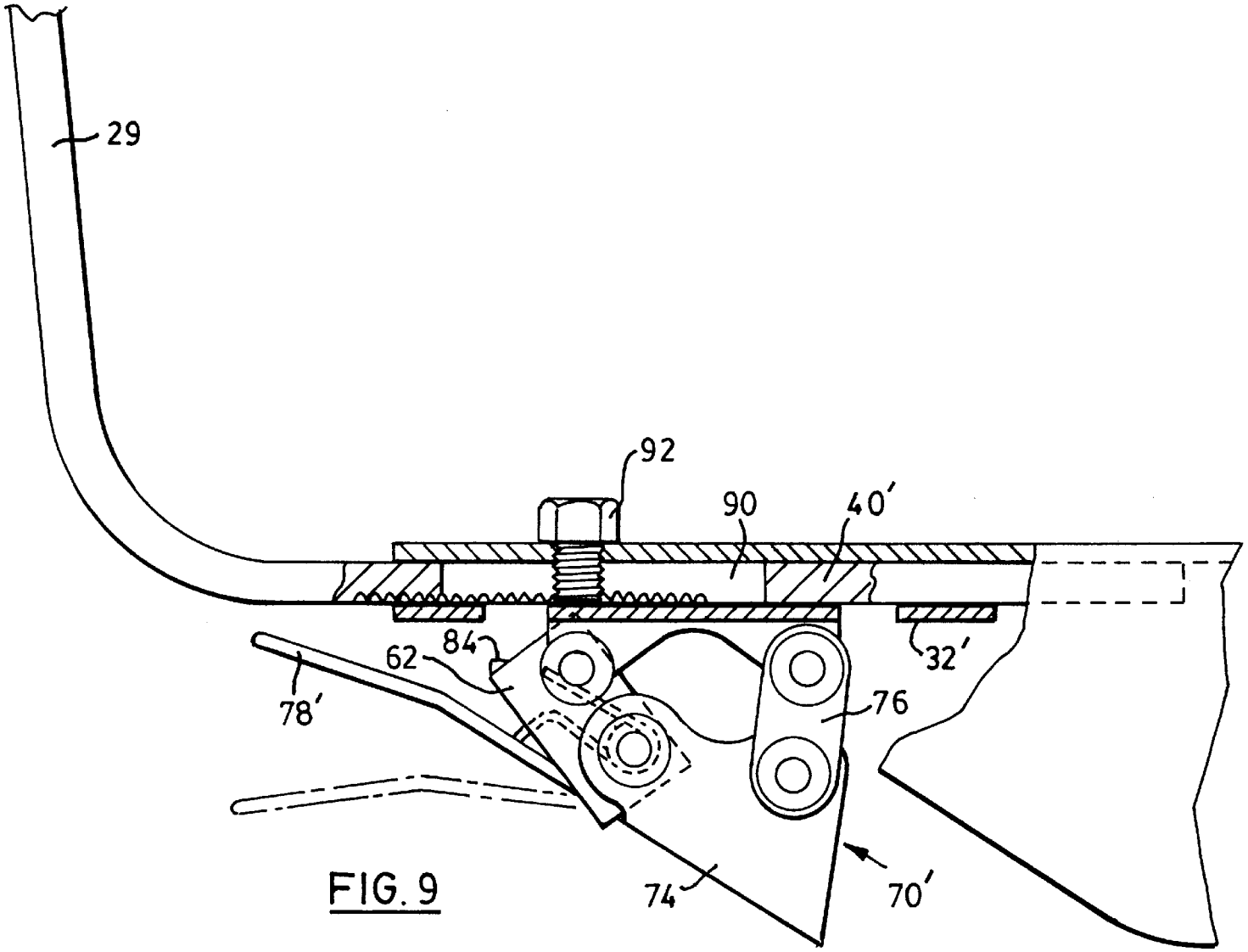
FIG. 9 is an elevational view of the chair control of FIG. 7 showing the handle in a disengaged position.
Figure 10:
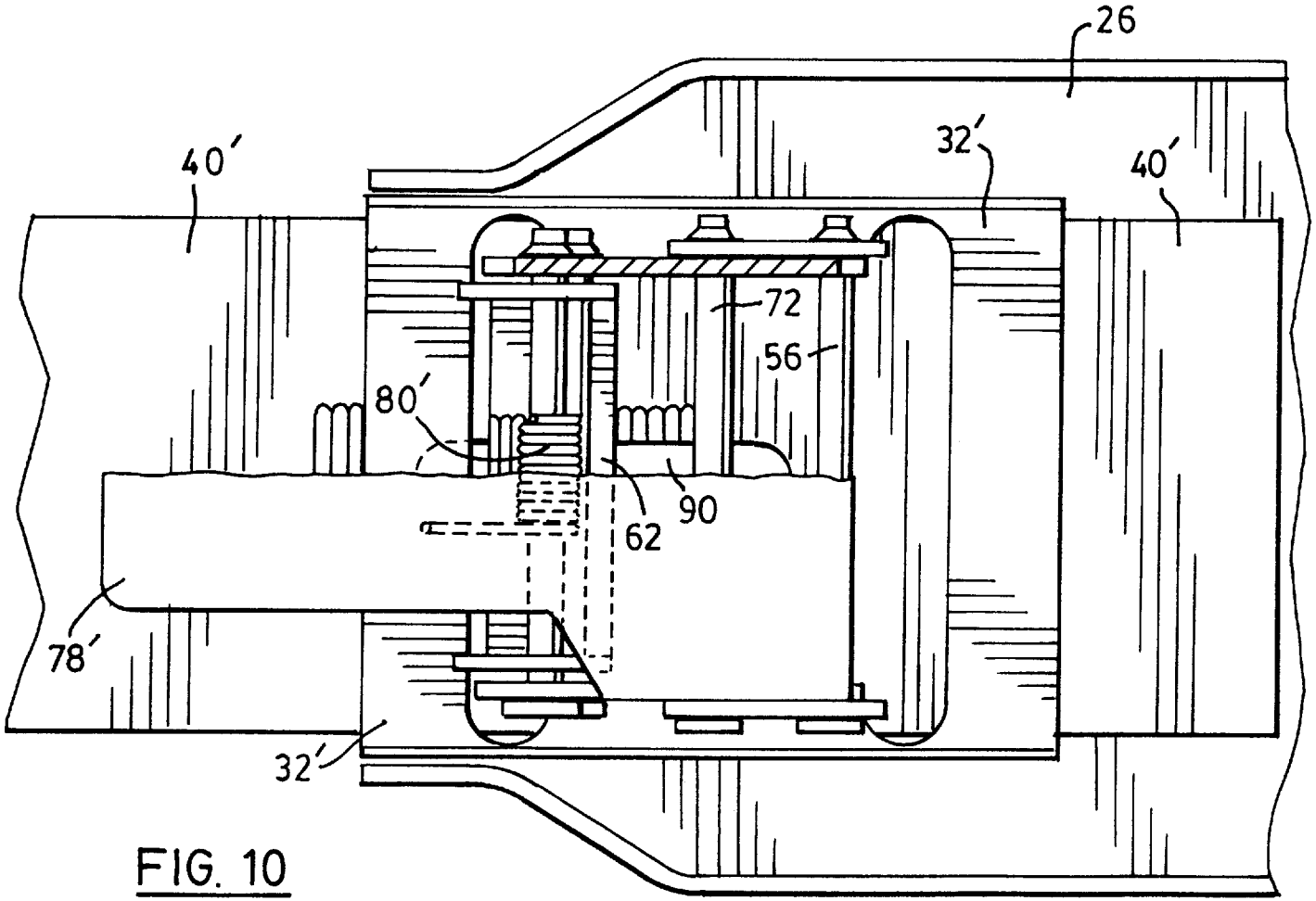
FIG. 10 is a bottom view taken along lines 10—10 of FIG. 7.

The operation of chair control 20 is similar to that of chair control 10 as well. FIG. 7 shows toggle linkage 70' in the over-the-centre fully locked position, so that support bar 40' cannot move longitudinally. In FIG. 8, handle 78' has been moved upwardly to the safety locked position. Lever 62 is still engaged with support bar 40'. Spring 80' is holding linkage 70' in this locking position. As handle 78' is moved further upwardly as indicated in FIG. 9, toggle linkage 70' causes lever 62 to rotate out of engagement with support bar 40' allowing support bar 29 and thus chair back 28 to be adjusted as desired. Release of handle 78' then provides a temporary or safety lock of the chair back in position, and further downward movement of handle 78' fully locks the chair back into position.

Having described preferred embodiments of the invention, it will be appreciated that various modifications may be made to the structures described above. For example, chair control 10 and 20 have been described having two parallel over-the-centre toggle linkages, one being mounted on each side of mounting bracket 32. However, it will be appreciated that only one toggle linkage on one side of mounting bracket 32, or perhaps centrally mounted is all that is required with appropriate modifications to lever 62. Instead of using pivot pins that extend transversely across the width of mounting bracket 32, short pivot pins on each side of mounting bracket 32 could be used with appropriate modification of spring 80. Handle 78 could be attached to either of the links 74, 76. Other modifications could be made to the shape or configuration of various of the components as will be appreciated by those skilled in the art.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A chair control for adjusting the position of a chair armrest or back having a transverse support bar for mounting the armrest or back, the chair control comprising:

a mounting bracket having a slot for slidably retaining said support bar therein to permit longitudinal position adjustment thereof; the mounting bracket including a first pivot pin spaced transversely of the support bar; a rigid lever pivotally mounted on said pivot pin, the lever having a first end portion adapted to pivot into frictional engagement with the support bar and a second end portion remote therefrom; the mounting bracket having a second pivot pin spaced from the first pivot pin; a toggle linkage having a central pivot and opposed links coupled respectively between the lever second end portion and the second pivot pin, so that transverse reciprocal movement of said central pivot causes the lever first end portion to pivot into and out of engagement with the support bar; and means for releasably retaining the toggle linkage in a locked position where the lever first end portion is in engagement with the support bar.

2. A chair control as claimed in claim 1 wherein the toggle linkage is an over-the-centre toggle, and wherein the mounting bracket includes a stop for engagement with the toggle linkage in the over-the-centre position, the means for releasably retaining the toggle linkage in a locked position being said stop.

3. A chair control as claimed in claim 2 and further comprising a handle attached to one of the toggle linkage links for transversely moving said central pivot by moving said link with the handle.

4. A chair control as claimed in claim 1 and further comprising a handle attached to one of the toggle linkage links for transversely moving said central pivot by moving said link with the handle.

5. A chair control as claimed in claim 1 and further comprising a spring attached to the mounting bracket and engaging the toggle linkage for biasing the toggle linkage toward said locked position.

6. A chair control as claimed in claim 5 wherein the spring is strong enough to be the means for releasably retaining the toggle linkage in the locked position.

7. A chair control as claimed in claim 1 wherein the mounting bracket has a pair of spaced-apart side walls, said side walls being located on either side of the support bar, said first and second pivot pins extending between said side walls, and wherein the lever is an inverted U-shaped bracket, the legs of the "U" being pivotally mounted on the first pivot pin, the bottom of the "U" being said first end portion and the distal ends of said legs being second end portions of the lever, said toggle linkage being coupled between one of said second end portions and the second pivot pin.

8. A chair control as claimed in claim 7 and further comprising a second such toggle linkage coupled between the other of said second end portions and the second pivot pin.

9. A chair control as claimed in claim 8 and further comprising a handle attached to adjacent toggle linkage links for moving in unison said links and the respective central pivots.

10. A chair control for adjusting the position of a chair component such as an armrest or a back, the chair control comprising:

a support bar for mounting said chair component thereon; a mounting bracket having a slot for slidably retaining said support bar therein to permit longitudinal position adjustment thereof; the mounting bracket including a first pivot pin spaced transversely of the support bar;

a rigid lever pivotally mounted on said pivot pin, the lever having a first end portion adapted to pivot into frictional engagement with the support bar and a second end portion remote therefrom; the mounting bracket having a second pivot pin spaced from the first pivot pin; a toggle linkage having a central pivot and opposed links coupled respectively between the lever second end portion and the second pivot pin, so that transverse reciprocal movement of said central pivot causes the lever first end portion to pivot into and out of engagement with the support bar; and means for releasably retaining the toggle linkage in a locked position where the lever first end portion is in engagement with the support bar.

11. A chair control as claimed in claim 10 wherein the rigid lever first end portion has a transverse edge for engagement with the support bar, and wherein the support bar includes a plurality of transverse, parallel grooves located to receive selectively said transverse edge.

12. A chair control as claimed in claim 11 and further comprising a spring attached to the mounting bracket and engaging the toggle linkage for biasing the toggle linkage toward said locked position.

13. A chair control as claimed in claim 12 wherein the spring is strong enough to be the means for releasably retaining the toggle linkage in the locked position.

14. A chair control as claimed in claim 13 wherein the toggle linkage is an over-the-centre toggle, and wherein the mounting bracket includes a stop for engagement with the toggle linkage in the over-the-centre position.

15. A chair control as claimed in claim 14 wherein the mounting bracket has a pair of spaced-apart side walls, said side walls being located on either side of the support bar, said first and second pivot pins extending between said side walls, and wherein the lever is an inverted U-shaped bracket, the legs of the "U" being pivotally mounted on the first pivot pin, the bottom of the "U" being said first end portion and the distal ends of said legs being second end portions of the lever, said toggle linkage being coupled between one of said second end portions and the second pivot pin.

16. A chair control as claimed in claim 15 and further comprising a second such toggle linkage coupled between the other of said second end portions and the second pivot pin.

17. A chair control as claimed in claim 16 and further comprising a handle attached to adjacent toggle linkage links for moving in unison said links and the respective central pivots.

18. A chair control as claimed in claim 13 and further comprising a handle attached to one of the toggle linkage links for transversely moving said central pivot by moving said link with the handle.

19. A chair control as claimed in claim 13 and further comprising a removable stop mounted on one of the support bar and the mounting bracket to engage the other of the support bar and the mounting bracket to prevent the support bar from sliding all the way out of the mounting bracket.

20. A chair control as claimed in claim 12 wherein the toggle linkage is an over-the-centre toggle, and wherein the mounting bracket includes a stop for engagement with the toggle linkage in the over-the-centre position.

* * * * *